United States Patent [19]

Howell

[11] 4,286,251

[45] Aug. 25, 1981

[54] VITREOUS ENAMEL RESISTOR AND METHOD OF MAKING THE SAME

[75] Inventor: Robert G. Howell, Boone, N.C.

[73] Assignee: TRW, Inc., Cleveland, Ohio

[21] Appl. No.: 17,262

[22] Filed: Mar. 5, 1979

[51] Int. Cl.[3] ..... H01C 1/012

[52] U.S. Cl. ..... 338/309; 29/621; 252/514; 252/518; 219/543; 338/308; 427/101; 428/433

[58] Field of Search ..... 338/308, 309, 327; 428/426, 427, 428, 432, 433, 457; 29/621; 252/512, 514, 515, 518; 427/101, 102, 376 A, 376 B, 377, 383 B; 219/543

[56] References Cited

U.S. PATENT DOCUMENTS

| | | | |
|---|---|---|---|
| 3,180,841 | 4/1965 | Murphy | 252/515 |
| 3,304,199 | 2/1967 | Faber, Sr. et al. | 428/426 |
| 3,358,362 | 12/1967 | McElroy | 29/621 |
| 3,394,087 | 7/1968 | Huang et al. | 252/512 |
| 3,794,518 | 2/1974 | Howell | 428/428 |
| 3,914,514 | 10/1975 | MacKenzie et al. | 428/426 |
| 4,053,866 | 11/1977 | Merz et al. | 338/309 |
| 4,057,777 | 11/1977 | Merz et al. | 338/309 |
| 4,168,344 | 9/1979 | Shapiro et al. | 428/427 |
| 4,172,922 | 10/1979 | Merz et al. | 428/432 |

*Primary Examiner*—Volodymyr Y. Mayewsky
*Attorney, Agent, or Firm*—Jacob Trachtman

[57] ABSTRACT

A vitreous enamel resistor, and method of making the same comprising the steps of applying to the surface of a substrate and firing a mixture of glass frit and particles of a precious metal oxide such as iridium oxide, ruthenium oxide, and mixtures thereof. The mixture is fired in a neutral, inert, or reducing atmosphere for a time and at a temperature resulting in a controlled partial dissociation of the oxide and softening of the glass frit. When cooled, a resistor is provided having a glass film with conductive particles therein strongly bonded to the substrate. The resistor produced can be terminated by the use of electroless plating.

28 Claims, 1 Drawing Figure

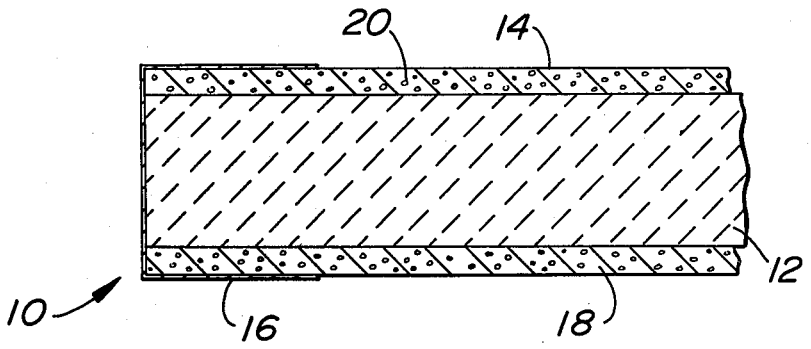
20
14
12
10
16
18

VITREOUS ENAMEL RESISTOR AND METHOD OF MAKING THE SAME

The present invention relates to a vitreous enamel resistor and a method of making the same, and more particularly to a resistor of a precious metal oxide which can be terminated by an electroless plated film and the method of making same.

A vitreous enamel resistor comprises a substrate having a film of glass and particles of a conductive material embedded in and dispersed throughout the glass film. The resistor is made by first forming a mixture of a glass frit and particles of the conductive material. The mixture is applied to the substrate and fired at a temperature at which the glass frit softens. Certain vitreous resistors such as those utilizing precious metals and precious metal oxides are made by firing in an oxidizing atmosphere, while other vitreous resistors such as those using refractory metals, and refractory metal borides and nitrides, are formed by firing in a non-oxidizing environment. When cooled, the glass solidifies to form the resistor with a glass film having the conductive particles therein.

In order to provide an electrical connection to the resistor, it is desirable to provide a conductive termination at each end of the resistance film. Heretofore, as disclosed in U.S. Pat. No. 3,358,362 issued Dec. 19, 1967, terminations for vitreous enamel resistors have been provided by the electroless plating of a film of a metal, such as nickel or copper. However, it has been found that such metal film terminations are not compatible with certain vitreous enamel resistance products, and particularly with iridium oxide and ruthenium oxide vitreous enamel resistors such as disclosed in U.S. Pat. No. 3,304,199 of Faber et al, which can not be terminated by such electroless plated films.

Therefore, it is an object of the invention to provide a novel vitreous enamel resistor and the method of making same.

Another object of the invention is to provide a novel resistor and termination and the method of making same.

Another object of the invention is to provide a new and improved resistor of high quality which can be produced with a desirable and low cost termination.

Another object of the invention is to provide a novel vitreous enamel resistor which can be terminated by an electroless plated metal film and the method of making same.

Another object of the invention is to provide a novel vitreous enamel resistor containing iridium oxide, ruthenium oxide or a mixture thereof which can be terminated by an electroless plated nickel or copper film and the method of making same.

Another object of the invention is to provide a novel method of making a resistor with a wide range of resistivities and low temperature coefficients of resistance.

Another object of the invention is to provide a novel vitreous enamel resistor having a high resistivity and relatively low temperature coefficient of resistance and the method of making same.

Another object of the invention is to provide a novel precious metal oxide resistor and method of making same in which resistivities can be lowered without requiring an increase in the content of the precious material.

Another object of the invention is to provide a novel method of making a high quality resistor in which the properties of the resistor may readily be controlled and the resistor can be easily fabricated.

These objects are achieved by applying a coating to a substrate of a mixture of a glass frit and particles of iridium oxide, ruthenium oxide, or mixtures thereof. The substrate and coating are then heated or fired in an atmosphere and at a temperature at which the glass frit softens, the metal oxide partially dissociates, and a glass film is formed which is strongly bonded to the substrate. The firing atmosphere may be neutral or inert, or reducing, as for example, provided by argon, nitrogen, or forming gas and may also include a proportion of air, for controlling the degree of dissociation of the oxide. With sufficient temperature, the degree of dissociation of the iridium and ruthenium oxide will increase as the firing time increases, and if sufficiently prolonged can result in the complete dissociation of the entire content of the oxides to their metals. The coated substrate, however, is heated over a time duration depending upon the atmosphere and firing temperature for obtaining the partial dissociation of the oxides to the desired degree.

The resistor thus formed can be terminated by a nickel or copper film applied in contact with a portion of the resistor glass film by an electroless plating process as described in U.S. Pat. No. 3,358,362.

The invention accordingly comprises the several steps of the method and the relation of one or more of such steps with respect to each of the others, and the resistor and its termination possessing the features, properties, and the relationships of constituents which are exemplified in the following detailed disclosure, with the scope of the invention being indicated by the claims.

For a fuller understanding of the nature and objects of the invention, reference should be had to the following detailed description taken in connection with the accompanying drawing.

The FIGURE of the drawing is a sectional view of a resistor of the present invention terminated by an electroless plated film.

Referring to the drawing, a resistor 10 embodying the invention comprises a substrate 12 and a resistance film 14 on the surface of the substrate. The substrate 12 may be in the form of a rod and composed of an electrical insulating material, such as ceramic, alumina or steatite. The resistance film 14 is a vitreous enamel film which comprises a film of glass 18 having particles of a conductive material 20 embedded therein and dispersed therethroughout. The resistor 10 may include a metal termination film 16 in contact with the resistance film 14, which film may be of nickel or copper and applied by an electroless plating method.

The conductive material 20 is provided by particles of an oxide of iridium, an oxide of ruthenium, or mixtures thereof, and the products of the partial dissociation of the oxides present, which are embedded in and dispersed throughout the glass film 18. The amount of the metal oxides and dissociation products present in the resistance film 14 is desirably between 10% and 70% by weight. The glass used may be any glass which is substantially stable at the dissociating temperature of the metal oxide particles and which has a suitable softening temperature, i.e., a softening temperature which is below the melting point of the oxide particles. The glasses which are most preferable are the borosilicate glasses, such as bismuth, and cadmium borosilicates, and barium, calcium and other alkaline earth borosilicates.

To make the resistance film 14, a resistance material is first prepared. The resistance material comprises a mixture of a fine glass frit and particles of either iridium oxide, ruthenium oxide, or mixtures of the oxides. While the amount of the oxide or oxides which may be included is dependent on the content of conductive particles required for providing the selected resistance, an amount of 10 to 70% by weight is desirable, and an amount of 20 to 50% by weight is preferable.

The glass frit and the metal oxide particles are thoroughly mixed together, such as by milling, in a suitable vehicle, such as water, butyl carbitol acetate, a mixture of butyl carbitol acetate and toluol, or any other well known screening medium. The viscosity of the mixture is then adjusted for the desired manner of applying the material either by adding or removing some of the vehicle medium.

The resistance material is then applied to the substrate 12 by any desired technique, such as brushing, dipping, spraying or screen stencil application. The coated film is then preferably dried, as by heating at a low temperature, such as 150° C. for about 10 minutes. Next, the film may be heated at a higher temperature, of about 400° C. or higher, to burn off the vehicle. Finally, the film is fired at a temperature at which the glass softens, generally of at least 600° C. and preferably between 1000° C. to 1100° C., in a neutral or inert, or reducing atmosphere, such as provided by argon or nitrogen, or a mixture of same. The atmosphere may also be adjusted for controlling the degree of oxide dissociation which takes place and determining the resistivity and temperature coefficient of resistance for the resistors produced by, for example, using an argon or nitrogen atmosphere where a proportion of air is also present. After the resistance film 14 is formed and cooled on the substrate 12, the conductive termination film 16 can be applied to the substrate by electroless plating in the manner well known in the art.

EXAMPLE I

A resistance material was made by ball milling together a mixture of 20% by weight of iridium oxide ($IrO_2$) with 80% by weight of an alkaline earth borosilicate frit in a butyl carbitol acetate medium. The glass was composed, by weight, of 52% barium oxide (BaO), 20% boron oxide ($B_2O_3$), 20% silicon dioxide ($SiO_2$), 4% aluminium oxide ($Al_2O_3$), and 4% titanium oxide ($TiO_2$).

Alumina rods were coated by being dipped in the resistance material, dried and then fired over a cycle of approximately 20 minutes at a temperature and in an atmosphere shown below in Table I. The cooled coated rods were cut to the size of individual resistors and then subjected to electroless plating for providing a nickel termination film. The resistance values, temperature coefficients of resistance, and the ability to terminate the resistors by plating are provided below in Table I.

TABLE I

| Firing Temp. | Kiln Atmosphere | Appearance | Resistance (ohms/square) | TCR* | Success of Electroless Plating |
|---|---|---|---|---|---|
| 1000° C. | Air | Very Dark Black | 720,000 | +6 | Fails to Plate |
| 1000° C. | Nitrogen | Dark Black (lighter than above) | 145,000 | +187 | Plates |
| 1100° C. | Nitrogen | Metallic Gray | 63 | +3287 | Plates |

*Temperature Coefficient of Resistance in parts per million/°C. (PPM/°C.)

EXAMPLE II

A resistance material was made in the same manner as described in Example I, except that the glass content was 70% by weight, and the mixture also included ruthenium oxide ($RuO_2$) in an amount of 10% by weight of the oxides. The resistors were made in the same manner as described in Example I, except that the coated rods were fired at a temperature of 1030° C. in an atmosphere of air or nitrogen. The resistance values, temperature coefficients of resistance, and the ability to terminate by electroless plating are shown in Table II.

TABLE II

| Firing Temp. | Kiln Atmosphere | Resistance (ohms/square) | TCR (PPM/°C.) | Success of Electroless Plating |
|---|---|---|---|---|
| 1030° C. | Air | 500,000 | −49 | Fails to Plate |
| 1030° C. | Nitrogen | 220,000 | +13 | Plates |

In considering the examples, it is seen from Table I that the firing of the iridium oxide glaze in air provided resistors having a resistivity of 720,000 ohms/square and a very dark black appearance. The very dark black appearance indicated that the iridium oxide had not been dissociated, resulting in a resistor produced in accordance with the prior art as taught in Faber et al U.S. Pat. No. 3,304,199. This resistor could not be terminated by an electroless plated nickel film. An inspection of the resistors revealed that in most instances, no visable nickel was deposited on the glazes fired in air. In those few instances where nickel was deposited, the deposits were in isolated patches which were not well bonded to the glaze surface, and in the rare instances, where a more continuous nickel layer resulted, its adherence was so very poor that the deposit pulled off during the soldering of a lead making the termination unusable.

The firing of the iridium oxide glaze resistors at 1000° in nitrogen as shown in Table I, provided resistors having a color which was dark black, but lighter than the air fired resistors, indicating a controlled dissociation of iridium oxide in the glaze. The resistor were plated by the electroless method to provide a nickel termination with desirable properties. The resistors also had a resistivity of 145,000 ohms/square which was lower than the air fired glaze, and a more positive temperature coefficient of resistance. The addition of a proportion of air to the atmosphere provides an increased resistivity and shifts the temperature coefficient of resistance in the more negative direction, while the absence of air has the opposite effect, thereby, allowing the control of the degree of dissociation of the iridium oxide.

On the other hand, an increase in the firing temperature to 1100° C. in nitrogen as also shown in Table I, results in iridium oxide glaze resistors having a lighter metallic gray color indicating an increased degree and almost complete dissociation of the iridium dioxide.

These resistors can also be plated by electroless method and have the much lower resistivity of 63 ohms/square, and a much higher positive temperature coefficient of resistance of +3287. As already noted, the presence of some oxygen in the atmosphere will result in an increased resistivity and a lower temperature coefficient of resistance by decreasing the oxide dissociation which takes place over the firing interval.

Considering the resistors of Table II made of a glaze material containing a mixture of iridium oxide ($IrO_2$) and ruthenium oxide ($RuO_2$) and fired at 1030° C. in air and nitrogen, it is seen that the air-fired resistors failed to plate, while the nitrogen fired resistors could be terminated by an electroless plating process. The air fired resistors provided a resistivity of 500,000 ohms/square and a negative temperature coefficient of resistance of −49, while the resistors fired in nitrogen had their oxides partially dissociated to provide a lower resistivity of 200,000 ohms/square and a positive temperature coefficient of resistance of +13.

Although resistor glazes may be made of either iridium oxide or ruthenium oxide glaze composition, the use of a mixture of these oxides to provide a modified glaze material allows further control of the resistor properties. Thus, in addition to the firing atmosphere, temperature, and duration, further control of the resistor properties may be achieved by the proportion or ratio of iridium and ruthenium oxides utilized.

Although resistors may be formed over the entire range of oxide proportions, a ratio provided by an amount of weight of 70 to 95% of particles containing iridium, to 5 to 30% of particles containing ruthenium is preferable for achieving low temperature coefficients of resistance. As seen from Table II an extremely low temperature coefficient of resistance of +13 is provided by a resistor made from a glaze mixture including the oxides by weight of 90% iridium dioxide and 10% ruthenium dioxide, the total making up 30% by weight of the mixture of which 70% by weight is the glass frit.

The ability to control dissociation of iridium and ruthenium oxides of the resistance material, also provides a method for controlling the resistivity of the resistors over a wide range, and allows the resistors to be made having a lower resistivity without requiring an increase in the amount of conductive material utilized. This also provides resistors of lower cost.

The resistors of the invention produced with electroless plating terminations also exhibit outstanding stability. A 5.6 megohm, ¼ watt resistor with a temperature coefficient of resistance within ±100 parts per million/°C. made in accordance with Example I, was tested for stability, and exhibited an average load life change of 0.18% after being subjected to a temperature of 125° C. and 300 volts for 1000 hours, and an average change of 0.37% after 1000 hours of storage at a temperature of 175° C. Subsequent testing indicated a performance capability meeting MIL Standard 39017 to a extremely high resistor value in excess of 20 megohms. The invention, thus, provides high quality resistors with a resistivity over a range of approximately 100 to 200,000 ohms/square. The invention also provides resistors having low temperature coefficients of resistance within ±200 PPM/°C. and high stability with less than 1% change in resistance when subject to load life testing.

In addition to being terminatable by an electroless plating method, the resistors of the invention containing dissociated iridium and/or ruthenium oxide can also be terminated by other means, such as mechanical pressure contacts, fired on termination glazes, and termination materials made with metals and organic binders.

The present invention may be carried out and embodied in other specific forms without departing from the spirit or essential attributes thereof, and, accordingly, references should be made to the appended claims, rather than the foregoing specification as indicating the scope of the invention.

What is claimed is:

1. A method of making an electrical resistor comprising the steps of (a) coating the surface of an insulating substrate with a mixture of a glass frit and particles of a metal oxide selected from the group consisting of iridium oxide, ruthenium oxide, and mixtures thereof, (b) firing the mixture in an atmosphere and at a temperature to provide a controlled degree of dissociation of the oxide particles, and then (c) cooling the coated substrate to form a resistor film of glass having conductive particles dispersed therethrough and characterized by being terminable by an electroless plated metal film.

2. The method in accordance with claim 1 in which the mixture is fired at a temperature of at least 600° C. in a substantially neutral atmosphere.

3. The method in accordance with claim 1 in which the mixture is fired at a temperature of at least 600° C. in a substantially reducing atmosphere.

4. The method in accordance with claim 1 in which the mixture is fired at a temperature of 600° C. in a substantially nitrogen atmosphere.

5. The method in accordance with claim 4 in which the nitrogen atmosphere includes air for controlling the degree of dissociation of the particles.

6. The method in accordance with claim 1, 2, 3, 4, or 5 in which the mixture is fired at a temperature of between 1000° C. to 1100° C.

7. The method in accordance with claim 1 in which the metal oxide particles are present in the mixture in an amount of 10 to 70% by weight.

8. The method in accordance with claim 1 in which the metal oxide and dissociated particles are present in the mixture in an amount of 20 to 50% by weight.

9. The method in accordance with claim 1 which includes the step of forming a conductive termination layer in contact with the resistor film by electroless plating.

10. The method in accordance with claim 1, 2, 3, 7, or 8 in which the glass film includes particles containing iridium and ruthenium, the particles containing iridium being present in an amount of 70–90% by weight and the particles containing ruthenium being present in an amount of 5–30% by weight of the metal containing particles.

11. The method in accordance with claim 1, 2 or 3 in which the film is of a borosilicate glass.

12. An electrical resistor made by the steps of (a) coating the surface of an insulating substrate with a mixture of a glass frit and particles of a metal oxide selected from the group consisting of iridium oxide, ruthenium oxide, and mixtures thereof, (b) firing the mixture in an atmosphere and at a temperature to provide a controlled degree of dissociation of the oxide particles, and then (c) cooling the coated substrate to form a resistor film of glass having conductive particles dispersed therethrough and characterized by being terminable by an electroless plated metal film.

13. An electrical resistor made in accordance with claim 12 in which the mixture is fired at a temperature of at least 600° C. in a substantially neutral atmosphere.

14. An electrical resistor made in accordance with claim 12 in which the mixture is fired at a temperature of at least 600° C. in a substantially reducing atmosphere.

15. An electrical resistor made in accordance with claim 12 in which the mixture is fired at a temperature of 600° C. in a substantially nitrogen atmosphere.

16. An electrical resistor made in accordance with claim 15 in which the nitrogen atmosphere includes air for controlling the degree of dissociation of the particles.

17. An electrical resistor made in accordance with claim 12, 13, 14, 15, or 16 in which the mixture is fired at a temperature of between 1000° C. to 1100° C.

18. An electrical resistor made in accordance with claim 12 in which the metal oxide particles are present in the mixture in an amount of 10 to 70% by weight.

19. An electrical resistor made in accordance with claim 12 in which the metal oxide and dissociated particles are present in the mixture in an amount of 20 to 50% by weight.

20. An electrical resistor made in accordance with claim 12 which includes the step of forming a conductive termination film in contact with the resistor film by electroless plating.

21. An electrical resistor made in accordance with claim 12, 13, 14, 18, or 19 in which the glass film includes particles containing iridium and ruthenium, the particles containing iridium being present in an amount of 70–95% by weight and the particles containing ruthenium being present in an amount of 5–30% by weight of the metal containing particles.

22. An electrical resistor made in accordance with claim 12, 13, or 14 in which the film is of a borosilicate glass.

23. An electrical resistor characterized by being terminable by an electroless plated metal film comprising an insulating substrate, and a glass film on a surface of the substrate, the glass film having particles of metal oxide selected from the group consisting of an oxide of iridium, an oxide of ruthenium, and mixtures thereof, together with particles of the metal of the oxide particles, embedded within and dispersed throughout the glass film, which the metal oxide and metal particles are present in an amount of 10 to 70% by weight.

24. The electrical resistor of claim 23 in which the metal oxide and metal particles are present in an amount of 20 to 50% by weight.

25. The electrical resistor of claim 23 or 24 in which the glass film includes particles containing iridium and ruthenium, the particles containing iridium being present in an amount of 70–95% by weight and the particles containing ruthenium being present in an amount of 5–30% by weight of the metal containing particles.

26. The electrical resistor of claim 23 or 24 in which the glass film is of a borosilicate glass.

27. The electrical resistor of claim 23 or 24 in which the glass film is of an alkaline earth borosilicate glass.

28. The electrical resistor of claim 23 or 24 which includes a metal termination film in contact with the glass film.

* * * * *